US006952554B2

(12) United States Patent
Ahn et al.

(10) Patent No.: US 6,952,554 B2
(45) Date of Patent: Oct. 4, 2005

(54) WASTE TONER AGITATOR FOR AN ELECTROPHOTOGRAPHIC IMAGE FORMING APPARATUS

(75) Inventors: Byeong-hwa Ahn, Yongin-si (KR); Young-min Yoon, Yongin-si (KR); Jin-soo Lee, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 134 days.

(21) Appl. No.: 10/714,404

(22) Filed: Nov. 17, 2003

(65) Prior Publication Data

US 2004/0146326 A1 Jul. 29, 2004

(30) Foreign Application Priority Data

Dec. 13, 2002 (KR) ..... 10-2002-0079752

(51) Int. Cl.[7] ..... G03G 21/00; G03G 21/12
(52) U.S. Cl. ..... 399/358; 399/360
(58) Field of Search ..... 399/119, 120, 399/358, 359, 360, 393; 222/DIG. 1

(56) References Cited

U.S. PATENT DOCUMENTS 4,218,132 A * 8/1980 Iwai et al. ..... 399/358

FOREIGN PATENT DOCUMENTS

JP 57172366 A * 10/1982 ..... G03G/15/08
JP 03080284 A * 4/1991 ..... G03G/21/00
JP 2001312190 A * 11/2001 ..... G03G/21/10

* cited by examiner

*Primary Examiner*—Arthur T. Grimley
*Assistant Examiner*—Ryan Gleitz
(74) *Attorney, Agent, or Firm*—Roylance, Abrams, Berdo & Goodman, LLP

(57) ABSTRACT

A waste toner agitator for an electrophotographic image forming apparatus includes a plurality of protrusions protrusively formed on a top surface of a cassette and, an actuator that is pivotably installed on sidewalls of the waste toner container. The actuator has a shaft that is installed inside of the waste toner container and provides a plurality of agitating wings for agitating the waste toner, and also includes a pivoting part that is installed outside of the waste toner container, is connected to the shaft, and contacts each of the protrusions. The waste toner container further includes a plurality of elastic members that are installed opposite to the pivoting part and are placed between a plurality of supporting parts provided outside of the waste toner container, and return the actuator to its original position after the actuator contacts the protrusion and is pivoted away from its original position.

16 Claims, 6 Drawing Sheets

WASTE TONER AGITATOR FOR AN ELECTROPHOTOGRAPHIC IMAGE FORMING APPARATUS

BACKGROUND OF THE INVENTION

This application claims priority from Korean Patent Application No. 2002-79752, filed on Dec. 13, 2002, in the Korean Intellectual Property Office, the disclosure of which is incorporated herein in its entirety by reference.

1. Field of the Invention

The present invention relates to an electrophotographic image forming apparatus, and more particularly, to a waste toner agitator which agitates waste toner in a waste toner container so that removed waste toner does not become solid.

2. Description of the Related Art

In general, an electrophotographic image forming apparatuses is a device which prints a desired toner image by supplying ink to an electrostatic latent image formed on a photosensitive medium by a laser scanning unit (LSU) in response to a print signal.

In addition, the electrophotographic image forming apparatus is a device which obtains a desired image by transferring a toner image onto a printing medium using a potential difference between a photosensitive medium and a transfer unit or between the transfer unit and the printing medium. However, the toner image is not completely transferred while the toner image is transferred from the photosensitive medium onto the transfer unit or while the toner image is transferred from the transfer unit onto the printing medium, and a part of the toner image remains on the photosensitive medium or the transfer unit. The waste toner is removed by a waste toner removing unit and stored in the waste toner container.

As a printing operation is performed by the electrophotographic image forming apparatus, the amount of waste toner stored in the waste toner container increases, and the waste toner remains on only a part of the waste toner container. After a certain period of time, the waste toner becomes solid. Thus, an agitator that agitates the waste toner stored in the waste toner container is required.

The waste toner agitator is disclosed in U.S. Pat. No. 4,218,132 and Japanese Patent Publication Nos. Sho 57-172366 and Hei 03-080284, the contents of which are herein incorporated by reference.

FIG. 1 illustrates a structure of a waste toner agitator of an electrophotographic printer disclosed in Japanese Patent Publication No. Hei 03-080284.

A receiving intake 110 is provided on a top surface of a waste toner container 100. Waste toner 111 removed by a waste toner removing unit (not shown) is introduced into the receiving intake 110. The bottom surface of the waste toner container 100 is inclined at a predetermined angle. A cam member 130 is installed adjacent to the waste toner container 100. The cam member 130 is rotated by a driving unit (not shown) and contacts the waste toner container 100 whenever the cam member 130 is rotated. A spring 120 is installed opposite to the cam member 130 wherein the waste toner container 100 is placed therebetween.

If the cam member 130 contacts the waste toner container 100, the spring 120 is compressed, and if the cam member 130 is separated from the waste toner container 100, the waste toner container 100 returns to its original position by an elastic energy of the spring 120. This phenomenon occurs whenever the cam member 130 is rotated. Thus, if the cam member 130 is consecutively rotated, the waste toner container 100 moved to the left and right, as indicated by arrow Z in FIG. 1, and the waste toner 111 is agitated.

In a conventional waste toner agitator having the above structure, the cam member is driven using an additional driving unit. Thus, the driving unit and the cam member have to be connected to each other. As a result, the structure of the conventional waste toner agitator becomes complicated, and manufacturing costs increase.

In addition, the waste toner agitator shakes the waste toner container and agitates the waste toner stored in the waste toner container. Thus, the waste toner may leak out of the waste toner container.

SUMMARY OF THE INVENTION

The present invention provides a waste toner agitator having an improved structure in which waste toner is not stored in only a part of a waste toner container and does not become solid.

According to an embodiment of the present invention, an electrophotographic image forming apparatus comprises a waste toner container that stores waste toner remaining from a series of printing processes, and a waster toner agitator that agitates the waste toner stored in the waste toner container. The waste toner agitator comprises a plurality of protrusions protrusively formed on a top surface of a cassette, an actuator that is pivotably installed on sidewalls of the waste toner container and has a shaft that is installed inside of the waste toner container and provides a plurality of agitating wings for agitating the waste toner and a pivoting part that is installed outside of the waste toner container, is connected to the shaft, and contacts each of the protrusions. The waste toner agitator further comprises a plurality of elastic members that are installed opposite to the pivoting part and placed between a plurality of supporting parts provided outside of the waste toner container. The protrusions cause the actuator to pivot from its original position when the actuator contacts the protrusion. The plurality of elastic members returns the actuator after it contacts the protrusion and is pivoted from its original position

BRIEF DESCRIPTION OF THE DRAWINGS

The above and other aspects and advantages of the present invention will become more apparent by describing in detail a preferred embodiment thereof with reference to the attached drawings in which.

DETAILED DESCRIPTION OF THE INVENTION

Figure 1:
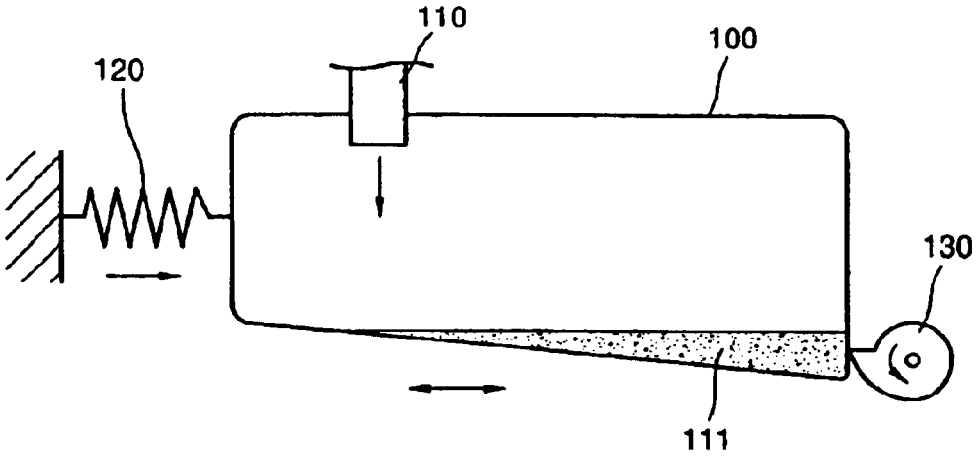
FIG. 1 (PRIOR ART)
FIG. 1 illustrates a structure of a conventional waste toner agitator of an electrophotographic image forming apparatus.

An embodiment of the present invention will now be described in detail with reference to the annexed drawings.

In the drawings, the same or similar elements are denoted by the same reference numerals even though they are depicted in different drawings. In the following description, a detailed description of known functions and configurations incorporated herein have been omitted for conciseness.

Figure 2:
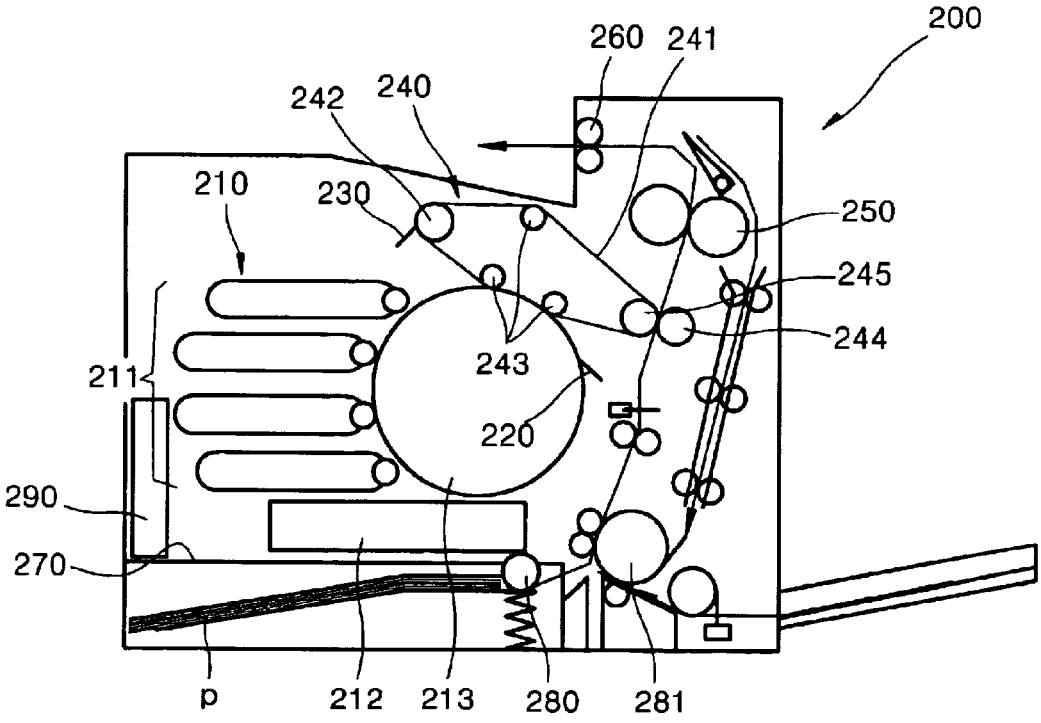
FIG. 2 schematically illustrates a structure of an electrophotographic image forming apparatus using an agitator according to an embodiment of the present invention.

FIG. 2 schematically illustrates a structure of an electrophotographic image forming apparatus using an agitator according to an embodiment of the present invention. As shown the electrophotographic image forming apparatus 200 includes a developing unit 210, a transfer unit 240, a fusing unit 250, a paper exhaust unit 260, and a pickup unit 280.

The developing unit 210 superposes ink supplied from a plurality of ink cartridges 211 on an electrostatic latent image formed on the surface of a photosensitive medium 213 by a laser scanning unit (LSU) 212, thereby forming a toner image.

The transfer unit 240 includes a transfer belt 241 and a transfer roller 244. The transfer belt 241 is supported by a plurality of support rollers 243, a steering roller 242, and a transfer backup roller 245. The transfer belt 241 is rotated in a closed trace shape, contacts the surface of the photosensitive medium 213, and, accordingly, the toner image formed on the surface of the photosensitive medium 213 is transferred onto the transfer belt 241. The transfer roller 244 is installed opposite to the transfer backup roller 245 wherein the transfer belt 241 is placed therebetween, and transfers the image formed on the surface of the transfer belt 241 onto a printing medium P.

The fusing unit 250 fuses the toner image onto the paper P by applying heat and pressure to the toner image transferred onto the paper P. The paper exhaust unit 260 exhausts the printing medium P onto which the toner image has been fused, outside of the main body.

The pickup unit 280 picks up a sheet of the printing medium P stacked on a cassette 270 that can be attached to or detached from the main body.

Reference numeral 220 denotes a photosensitive cleaning blade which is installed to contact the photosensitive medium 213 and removes toner remaining on the photosensitive medium 213. Reference numeral 230 denotes a transfer belt cleaning blade which is installed opposite to the steering roller 242 wherein the transfer belt 241 is placed therebetween and removes the toner remaining on the surface of the transfer belt 241.

Toner removed by the photosensitive medium cleaning blade 220 and the transfer belt cleaning blade 230 is stored in a waste toner container 290 placed above the cassette 270, by using a removing unit (not shown).

Figure 3:
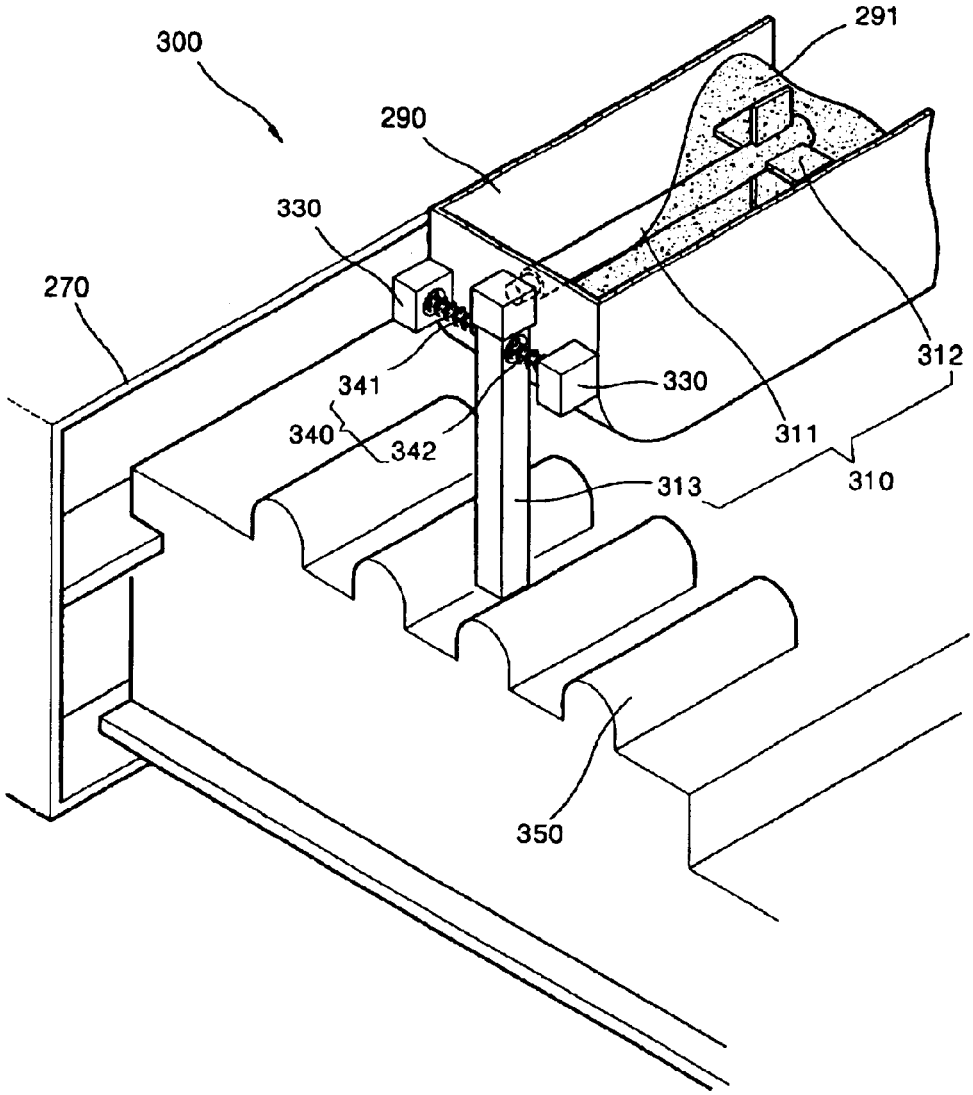
FIG. 3 is a perspective view illustrating a part of the electrophotographic image forming apparatus using the agitator according to an embodiment of the present invention.

Referring to FIG. 3, an agitator 300 according to an embodiment of the present invention is shown that includes an agitator 310, a plurality of elastic members 340, and a plurality of protrusions 350.

The actuator 310 includes a shaft 311 installed inside of the waste toner container 290, and a pivoting part 313 installed outside of the waste toner container 290. The shaft 311 and the pivoting part 313 can be formed as a single body or can be separately manufactured and connected to each other. The actuator 310 is pivotably installed in the waste toner container 290. Preferably, the actuator 310 is installed on sidewalls of the waste toner container 290.

A plurality of agitating wings 312 are provided on the ends of shaft 311. The plurality of agitating wings 312 are arranged along the circumference of the shaft 311 at predetermined intervals and agitate waste toner 291 stored in the waste toner container 290. The agitating wings 312 serves to agitate the waste toner 291 as the shaft 311 is rotated, and can be embodied in various designs while fulfilling an identical purpose.

Preferably, the agitating wings 312 are placed under an intake of the waste toner container 290. The agitating wings 312 can then serve to agitate the waste toner 291 as it drops into the waste toner cartridge 290, and is stored under the intake of the waste toner container 290.

The pivoting part 313 is placed between a plurality of supporting parts 330 provided outside of the waste toner container 290 at predetermined intervals, and is connected to each of the plurality of supporting parts 330 by the plurality of elastic members 340 installed opposite to the pivoting part 313. Each of the elastic members 340 includes a first spring 341 and a second spring 342.

Preferably, the shaft 311 and the pivoting part 313 are formed to be perpendicular to each other. Preferably, a connection part between the waste toner container 290 and the actuator 310 is sealed, so as to prevent the waste toner 291 stored in the waste toner container 290 from leaking out of the waste toner container 290. Thus, the actuator 310 is pivotably installed while being sealed in the waste toner container 290.

Each of the plurality of protrusions 350 is protrusively formed on the top surface of the cassette 270 to have a predetermined length perpendicular to a direction in which the cassette 270 enters into the main body. The plurality of protrusions 350 are provided in a direction in which the cassette 270 enters into the main body at predetermined intervals. Preferably, the shape of each protrusion 350 contacting the pivoting part 313 are rounded so that when each protrusion 350 contacts the pivoting part 313, the pivoting part 313 can smoothly ascend and descend the protrusion 350. Since the pivoting part 313 contacts each protrusion 350 while the cassette 270 enters into the main body, the shaft 311 is pivoted in the direction opposite to the direction in which the cassette 270 enters into the main body, and the agitating wings 312 agitate the waste toner 291 stored in the waste toner container 290.

Figure 4:
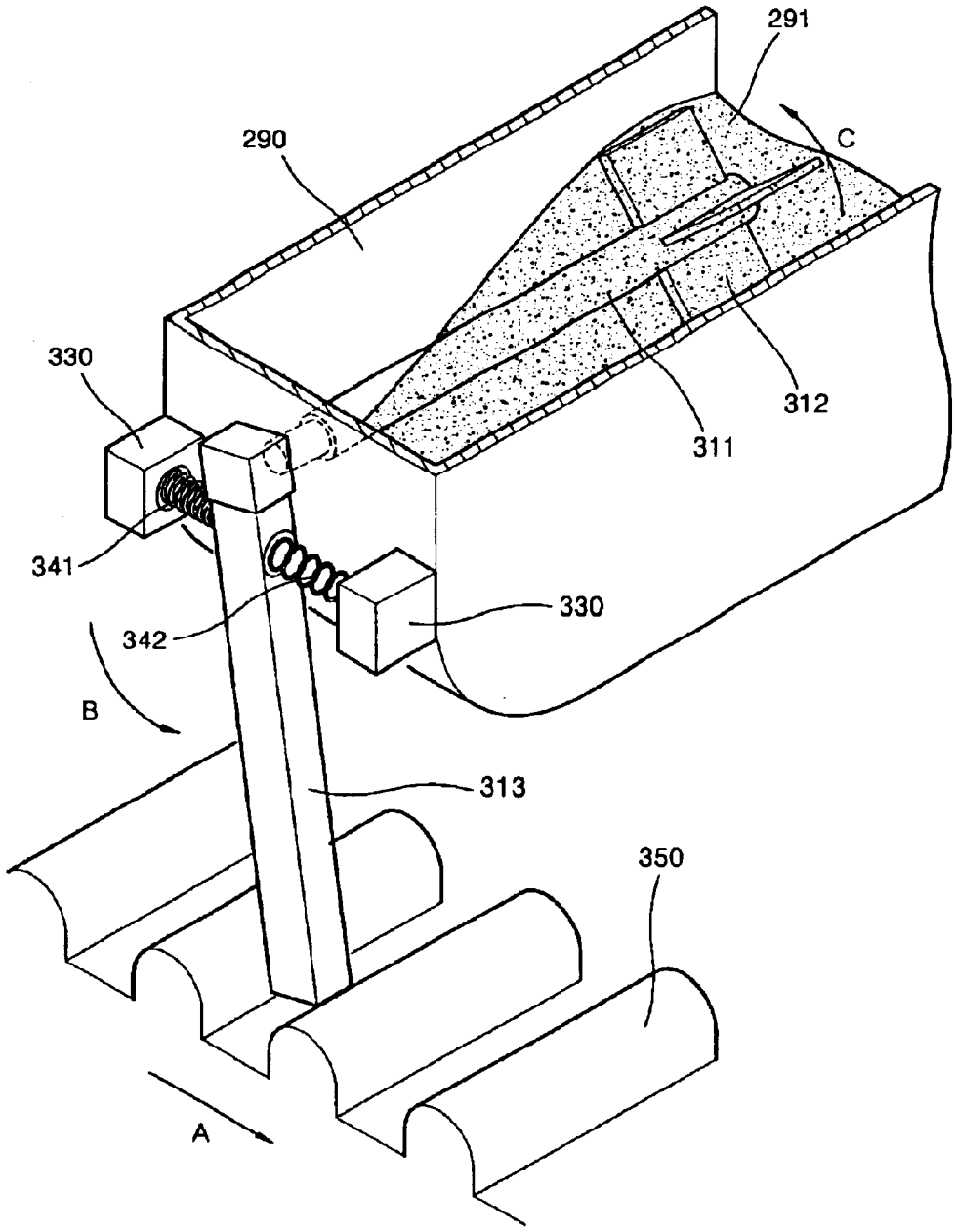
FIGS. 4 and 5 are perspective views illustrating the operation of the agitator according to an embodiment of the present invention when a cassette is inserted in a main body.
Figure 5:
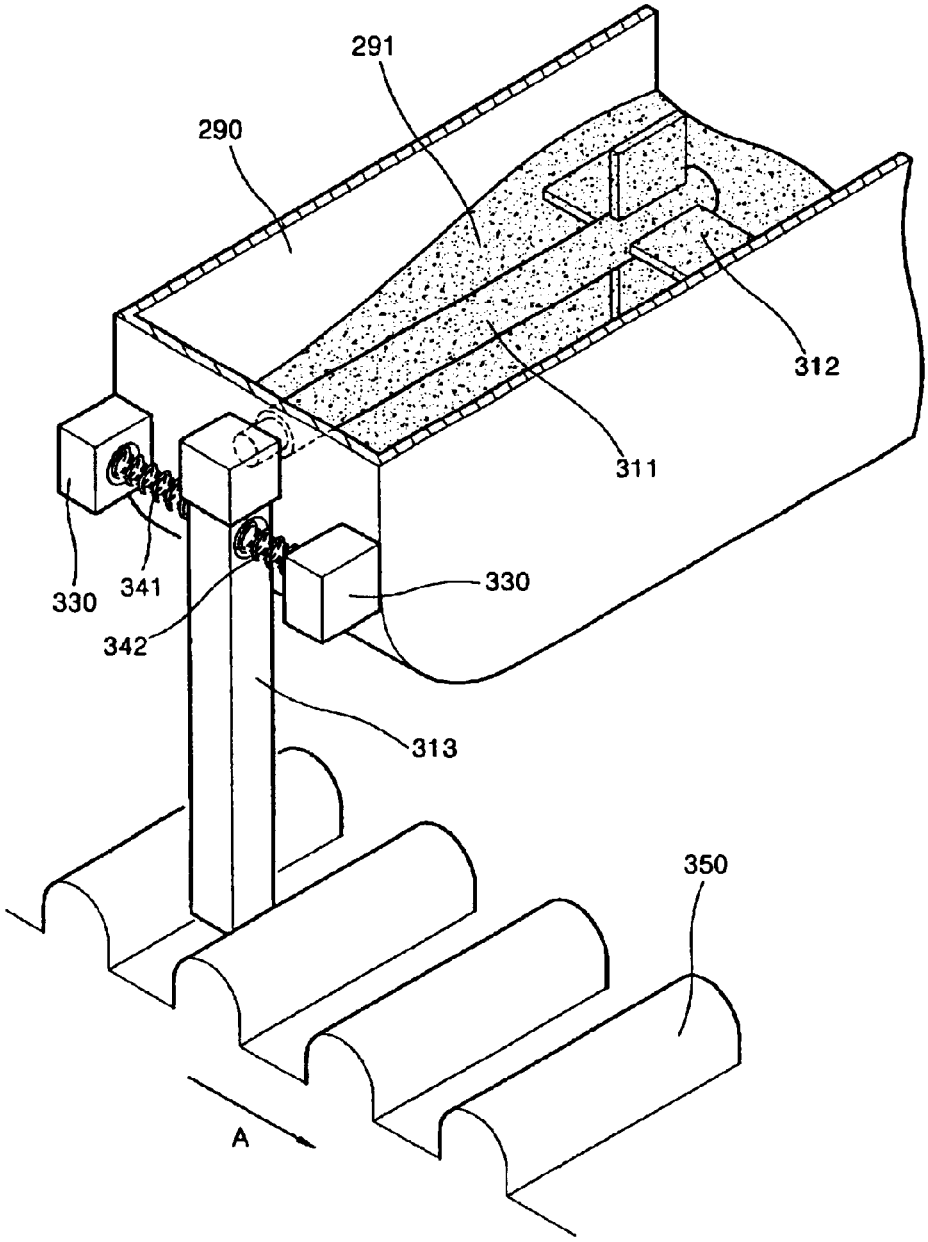

Referring to FIGS. 4 and 5, if the cassette 270 is moved in a direction A and is mounted in the main body, the pivoting part 313 is pivoted in a direction B while contacting the protrusion 350. Then, the shaft 311 is also pivoted in a direction C, and thus, the agitating wings 312 are pivoted in the direction C, and the waste toner 291 stored in waste toner container 290 is agitated.

In this case, the first spring 341 is compressed, and the second spring 342 extends while the pivoting part 313 is pivoted.

While the cassette 270 travels in the direction A, the pivoting part 313 travels over the second protrusion from the left side of FIG. 5 and is placed between the first and second protrusions from the left side of FIG. 5, as shown in FIG. 5. Then, the pivoting part 313 returns to its original position by the elastic energy stored in the first spring 341. In this case, the agitating wings 312 are pivoted in a direction opposite to the direction C and further agitates the waste toner 291. This operation is repeatedly performed whenever the pivoting part 313 contacts the plurality of protrusions 350 as the cassette 270 is mounted (or inserted) in the main body.

Figure 6:
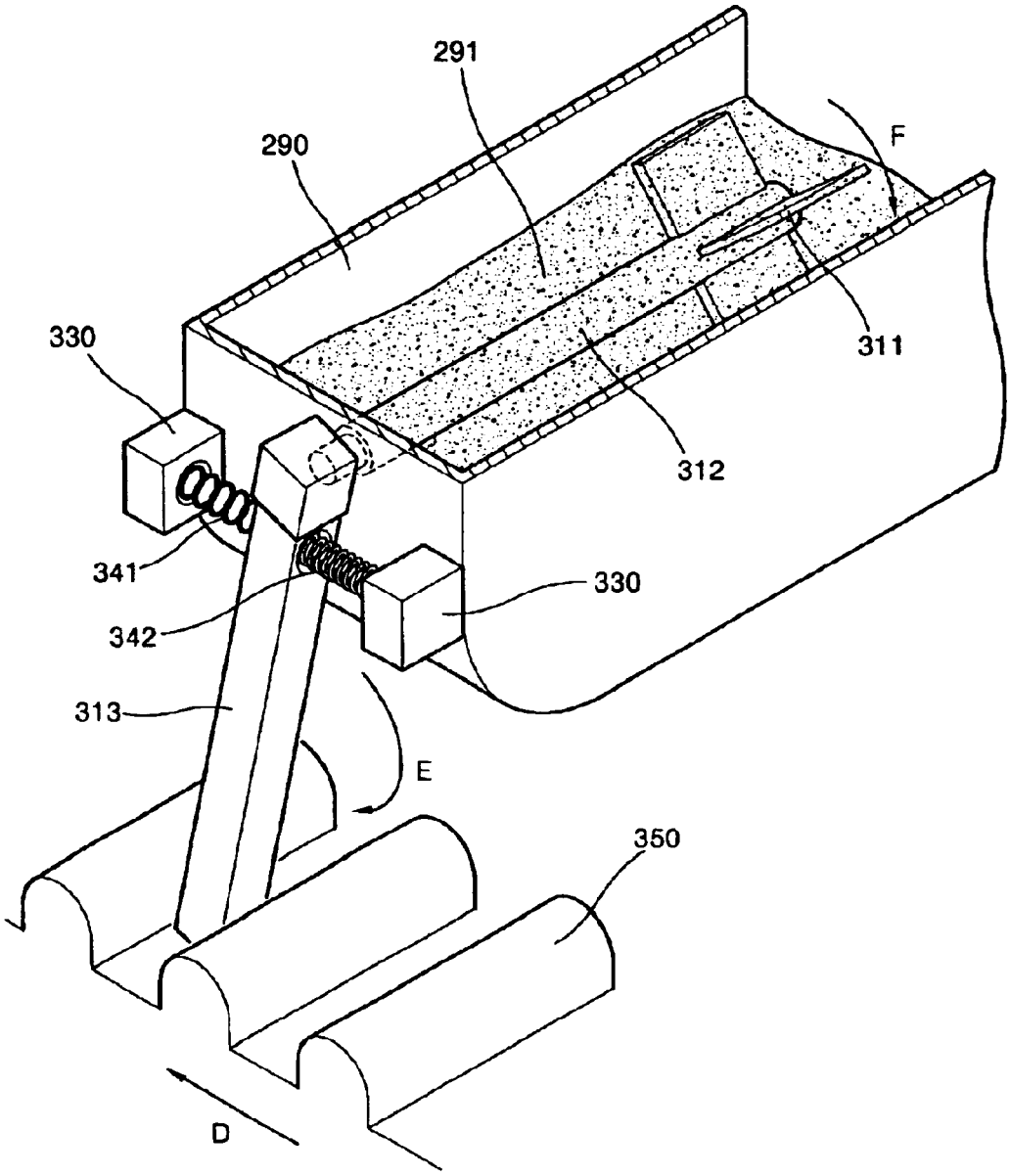
FIG. 6 is a perspective view illustrating the operation of the agitator according to an embodiment of the present invention when the cassette is removed from the main body.

Referring to FIG. 6, if the cassette 270 is moved in a direction D and is removed from the main body, the pivoting part 313 contacts the protrusion 350 and is pivoted in a direction E. Then, the shaft 311 is also pivoted in a direction F, and thus, the agitating wings 312 are pivoted in the direction F, and the waste toner 291 is agitated.

In this case, the second spring 342 is compressed, and the first spring 341 extends while the pivoting part 313 is pivoted. While the cassette 270 travels in the direction D, the pivoting part 313 is pivoted in the direction E and travels over a second protrusion from the right side of FIG. 6. In this case, the shaft 311 is pivoted in the direction F, and the agitating wings 312 agitate the waste toner 291 stored in the waste toner container 290.

If the pivoting part 313 is placed between first and second protrusions from the right side of FIG. 5, the pivoting part 313 returns to its original position by an elastic energy stored in the second spring 342. In this case, the agitating wings 312 are pivoted in a direction opposite to the direction F and agitate the waste toner 291 stored in the waste toner container 290.

As described above, the operation of agitating the waste toner 291 using the actuator 310 is performed while the cassette 270 is removed from, or inserted into, the main body, so as to load a printing medium in the cassette 270.

In general, the cassette 270 is mounted or removed in or from the main body on the basis of a minimum of 250 sheets of a printing medium. Thus, after approximately 250 sheets of a printing medium have been used, the agitator 300 agitates the waste toner 291 stored in the waste toner container 290.

In the electrophotographic image forming apparatus according to an embodiment of the present invention as described above, the operation of agitating waste toner stored in a waste toner container is performed when a cassette is mounted in, or removed from the main body. Therefore, an additional driving unit is not required, costs can be reduced, and the structure of the electrophotographic image forming apparatus can be simplified. In addition, the waste toner container self is not shaken, so the waste toner does not leak out of the waste toner container, and the waste toner container is not contaminated.

While the embodiment of the invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. An electrophotographic image forming apparatus comprising a waste toner container in which waste toner remaining after a series of printing processes is stored, and an agitator which agitates the waste toner stored in the waste toner container, wherein the agitator comprises:

at least one protrusion protrusively formed on a top surface of a cassette;

an actuator which is pivotably installed on sidewalls of the waste toner container, the actuator having a shaft which is installed inside of the waste toner container and provides at least one agitating wing for agitating the waste toner, and a pivoting part, which is installed outside of the waste toner container, is connected to the shaft, and contacts the at least one protrusion; and at least one elastic member coupled to the pivoting part and at least one supporting part provided outside of the waste toner container, and which returns the actuator to its original position after the actuator contacts the protrusion and is pivoted away from its original position.

2. The apparatus of claim 1, wherein the at least one protrusion is provided to have a predetermined length perpendicular to a direction in which the cassette enters into the main body.

3. The apparatus of claim 1, wherein the at least one protrusion is provided in a direction in which the cassette enters into the main body at predetermined intervals.

4. The apparatus of claim 1, wherein the shaft and the pivoting part are perpendicular to each other.

5. The apparatus of claim 1, wherein each of the at least one supporting part is protrusively formed on the sidewalls of the waste toner container.

6. The apparatus of claim 1, wherein the at least one agitating wing is placed under an intake of the waste toner container into which the waste toner enters.

7. The apparatus of claim 1, wherein the at least one agitating wing is protrusively formed on the circumstance of the shaft.

8. The apparatus of claim 1, wherein the at least one elastic member is coupled to the pivoting part and a respective one of a plurality of the supporting parts.

9. An agitator, for use with an electrophotographic image forming apparatus comprising a waste toner container in which waste toner remains after a series of printing processes is stored, the agitator comprising:

at least one protrusion protrusively formed on a top surface of a cassette;

an actuator, which is pivotably installed on sidewalls of the waste toner container, the actuator having a shaft which is installed inside of the waste toner container and provides at least one agitating wing for agitating the waste toner, and a pivoting part which is installed outside of the waste toner container, is connected to the shaft, and contacts the protrusion; and at least one elastic member which is coupled to the pivoting part placed along at least one supporting part provided outside of the waste toner container and returns the actuator to its original position after the actuator contacts the protrusion and is pivoted away from its original position.

10. The apparatus of claim 9, wherein the at least one protrusion is provided to have a predetermined length perpendicular to a direction in which the cassette enters into the main body.

11. The apparatus of claim 9, wherein the at least one protrusion is provided in a direction in which the cassette enters into the main body at predetermined intervals.

12. The apparatus of claim 9, wherein the shaft and the pivoting part are perpendicular to each other.

13. The apparatus of claim 9, wherein each of the at least one supporting part is protrusively formed on the sidewalls of the waste toner container.

14. The apparatus of claim 9, wherein the at least one agitating wing is placed under an intake of the waste toner container into which the waste toner enters.

15. The apparatus of claim 9, wherein the at least one agitating wing is protrusively formed on the circumstance of the shaft.

16. The apparatus of claim 9, wherein the at least one elastic member is coupled to the pivoting part and a respective one of a plurality of the supporting parts.

* * * * *